US007823596B2

(12) United States Patent
Fujikawa

(10) Patent No.: US 7,823,596 B2
(45) Date of Patent: Nov. 2, 2010

(54) HEAD WASHING DEVICE

(75) Inventor: Susumu Fujikawa, Saitama (JP)

(73) Assignee: Thales Co., Ltd., Tokyo (JP)

( * ) Notice: Subject to any disclaimer, the term of this patent is extended or adjusted under 35 U.S.C. 154(b) by 193 days.

(21) Appl. No.: 11/822,915

(22) Filed: Jul. 11, 2007

(65) Prior Publication Data

US 2009/0014039 A1 Jan. 15, 2009

(51) Int. Cl.
*B08B 3/04* (2006.01)

(52) U.S. Cl. ..... 134/104.4

(58) Field of Classification Search ..... 134/104.4
See application file for complete search history.

(56) References Cited

U.S. PATENT DOCUMENTS 2,533,722 A * 12/1950 De Remer ..... 68/23.3
3,468,319 A * 9/1969 Harmon ..... 132/212
4,258,731 A * 3/1981 Tsujimoto et al. ..... 132/212
4,944,876 A * 7/1990 Miller ..... 210/321.75
6,691,335 B1 * 2/2004 Keith ..... 4/518
2003/0232737 A1 * 12/2003 Stoessel et al. ..... 510/417
2007/0108640 A1 * 5/2007 Takahashi et al. ..... 261/76

* cited by examiner

*Primary Examiner*—Michael Cleveland
*Assistant Examiner*—Samuel A Waldbaum
(74) *Attorney, Agent, or Firm*—Arent Fox LLP

(57) ABSTRACT

A washing device for washing a portion of a user's head includes a discharge section which discharges a cleaning liquid into a washing cap attached to a portion of a user's head, and a recovery section which drains the cleaning liquid out of the washing cap so as to recover it. The device again discharges the cleaning liquid recovered by the recovery section from the discharge section, and recirculates the cleaning liquid so as to wash the portion of the user's head covered by the washing cap. When the cleaning liquid is dispersed into the washing cap, the cleaning liquid passes through a nozzle unit so that a lot of microbubbles are generated in the cleaning liquid. The microbubbles are very fine air bubbles, and can remove fine particles of dirt down to the order of a few microns but do not damage the user's scalp and hair.

12 Claims, 5 Drawing Sheets

HEAD WASHING DEVICE

BACKGROUND OF THE INVENTION

1. Field of the Invention

The present invention relates to a washing device for washing a portion of a user's head wherein said washing device discharges a cleaning liquid into a washing cap attached to a portion of the user's head so as to wash that portion of their head.

2. Description of the Related Art

Conventionally, much attention has been paid to the pores formed on the portion of a user's scalp which has, in particular, been washed with the intention of encouraging growth and/or an increase in the density of the user's hair. This is because various hair growth and hair thickening tonics are being developed, but when the pores of the scalp are blocked by oil secreted by the skin, the tonics can hardly reach the hair roots, and thus a hair growth effect and a hair density increase effect are somewhat inhibited.

A number of conventional washing devices for washing a portion of a user's head have been developed. For example, a device in which a washing cap is attached to a portion of a user's head, cleaning liquid is discharged into the washing cap, and the user's scalp is rubbed by a brush inserted into the washing cap so that the portion of the user's head covered by the washing cap is washed, is known (for example, Japanese Patent Application Laid-Open No. 2003-210240).

In this conventional device, the tips of a number of the bristles making up the brush are thicker than the pores of the scalp, and thus even when the scalp is rubbed by the brush, any oil secreted by the skin that is blocking the pores cannot be effectively removed. When the scalp is vigorously rubbed by the brush, the scalp may be undesirably damaged. When the cleaning liquid which strongly dissolves the oil secreted by the skin is used, the hair and scalp may also be undesirably damaged. Therefore, the conventional head washing device detailed above cannot effectively remove any oil secreted by the skin that is blocking the pores without damaging the scalp and hair.

SUMMARY OF THE INVENTION

A washing device for washing a portion of a user's head in accordance with the present invention includes: a discharge section which discharges a cleaning liquid into a washing cap attached to a portion of the user's head; and a recovery section which drains the cleaning liquid in the washing cap so as to recover it. The cleaning liquid recovered by the recovery section is again discharged from the discharge section and is circulated so as to wash the portion of the user's head covered by the washing device. Fine air bubbles called microbubbles are mixed with the cleaning liquid to be discharged from the discharge section.

Since the microbubbles are mixed with the cleaning liquid to be discharged into the washing cap, they can reach the pores together with the cleaning liquid because the microbubbles are at least several microns in diameter and at most several hundred microns in diameter. When the microbubbles disappear, they are compressed abruptly, and the energy released at that point is concentrated and an ultrasonic wave is generated so that oil secreted by the skin which blocks the pores can be removed effectively. Since the microbubbles hardly affect the cells of the human body, scalp and hair are not damaged.

The discharge section has a discharge pipe which sends the cleaning liquid into the washing cap and which is detachable from the washing cap, and a nozzle mechanism which generates microbubbles may be mounted to a vicinity of the front end of the discharge pipe.

In order to generate microbubbles, the nozzle is used to generate air to be dissolved into the cleaning liquid. However, when the nozzle mechanism, which includes the nozzle, is mounted not to the side of the washing cap but to the side of the discharge pipe, it is not necessary to prepare a plurality of nozzle mechanisms even if the washing cap is replaced.

A dispersing unit which disperses the cleaning liquid to be discharged into the washing cap in a plurality of directions inside the washing cap is provided, so as to be capable of spreading the cleaning liquid to the entire portion of the user's head covered by the washing cap in a uniform manner.

The recovery section includes a recovery pipe that is detachable from the washing cap, where the discharge pipe is capable of being detachably connected to the recovery pipe directly without any need for the washing cap. As a result, the cleaning liquid can be circulated without entering the washing cap, so that the cleaning liquid can be warmed or the inside of the circulating path can be easily washed.

A filter which removes any dirt mixed with the cleaning liquid recovered by the recovery section is housed in a transparent casing so as to form a unit. The filter unit may be replaceable.

With such a configuration, every time a portion of a user's head is washed, the filter can be easily replaced, and any hair that has fallen out can be observed. For this reason, the state of a portion of a user's head can be determined based on any hair or the like removed by the filter.

In the present invention, since the cleaning liquid with which the microbubbles are mixed is used for washing a portion of a user's head, the user's scalp and hair are not damaged, and fine indentations such as deep pores and damaged hair follicles can be securely washed.

DETAILED DESCRIPTION OF A PREFERRED EMBODIMENT

Figure 1:
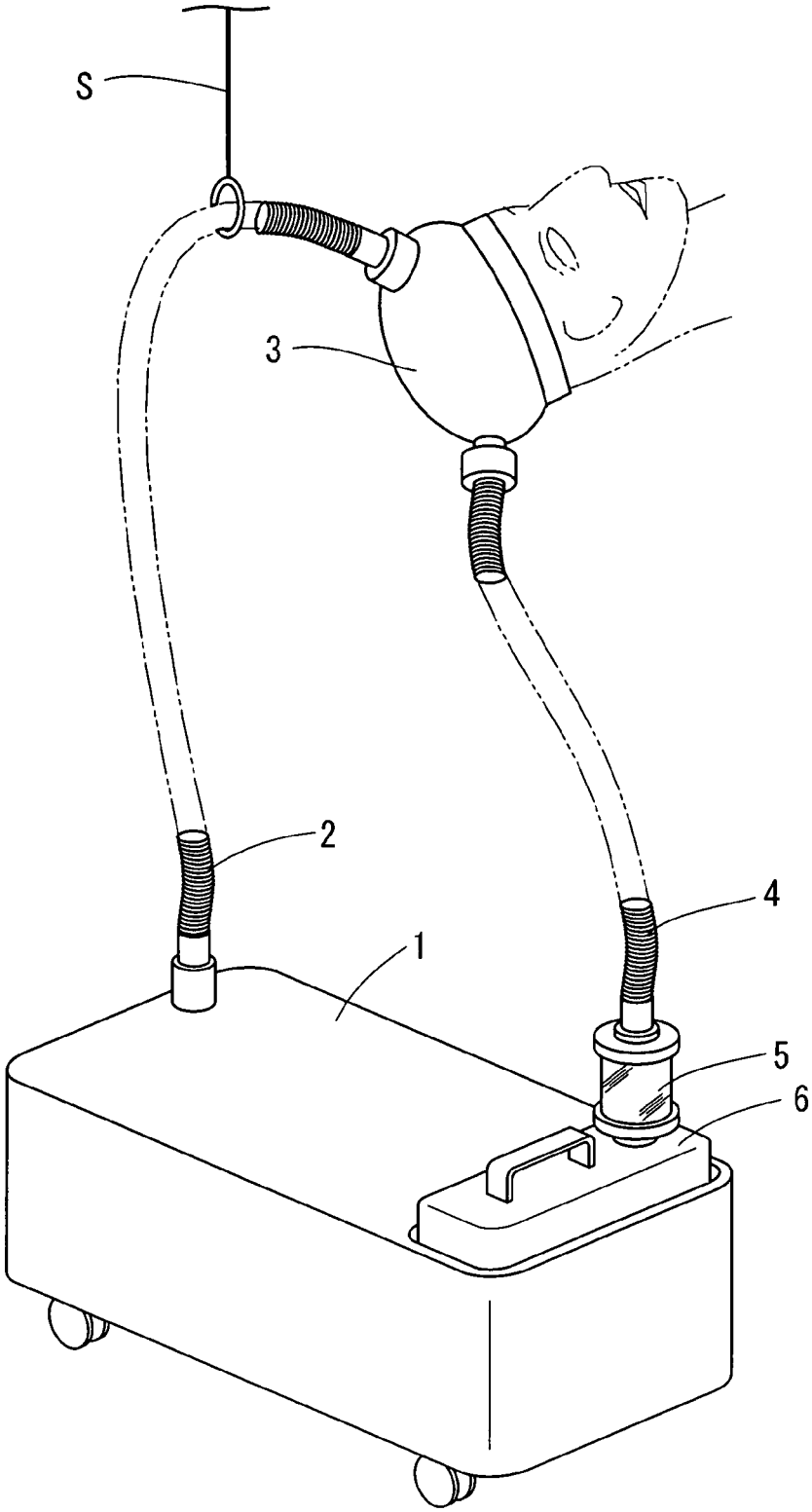
FIG. 1 is a diagram illustrating a configuration of a washing device in accordance with aspects of the present invention.

The main body 1 of the washing device for washing a portion of a user's head according to the present invention is shown in FIG. 1. A cleaning liquid is sent out from the main body 1 via a discharge pipe 2. The discharge pipe 2 is connected to a washing cap 3. The washing cap 3 is attached to a portion of a user's body like a hat, wherein said user is usually a human. The person whose head is to be washed sits on a chair with the devise, and the seat backrest reclines backward to position the user in an approximately upward facing state. The cleaning liquid is discharged from the discharge pipe 2 into the washing cap 3 so as to wash the portion of the user's head covered by the washing cap 3. The cleaning liquid passes from the washing cap 3 through a recovery pipe 4 and is recovered by a filter unit 5. Hair and dirt such as dandruff are removed by the filter unit 5 and are recovered by a cartridge tank 6. Since the discharge pipe 2 is suspended in a suitable position by a suspending tool S, when the cleaning liquid is circulated, the discharge pipe 2 and the washing cap 3 do not slump downward due to weight of the cleaning liquid.

Figure 2:
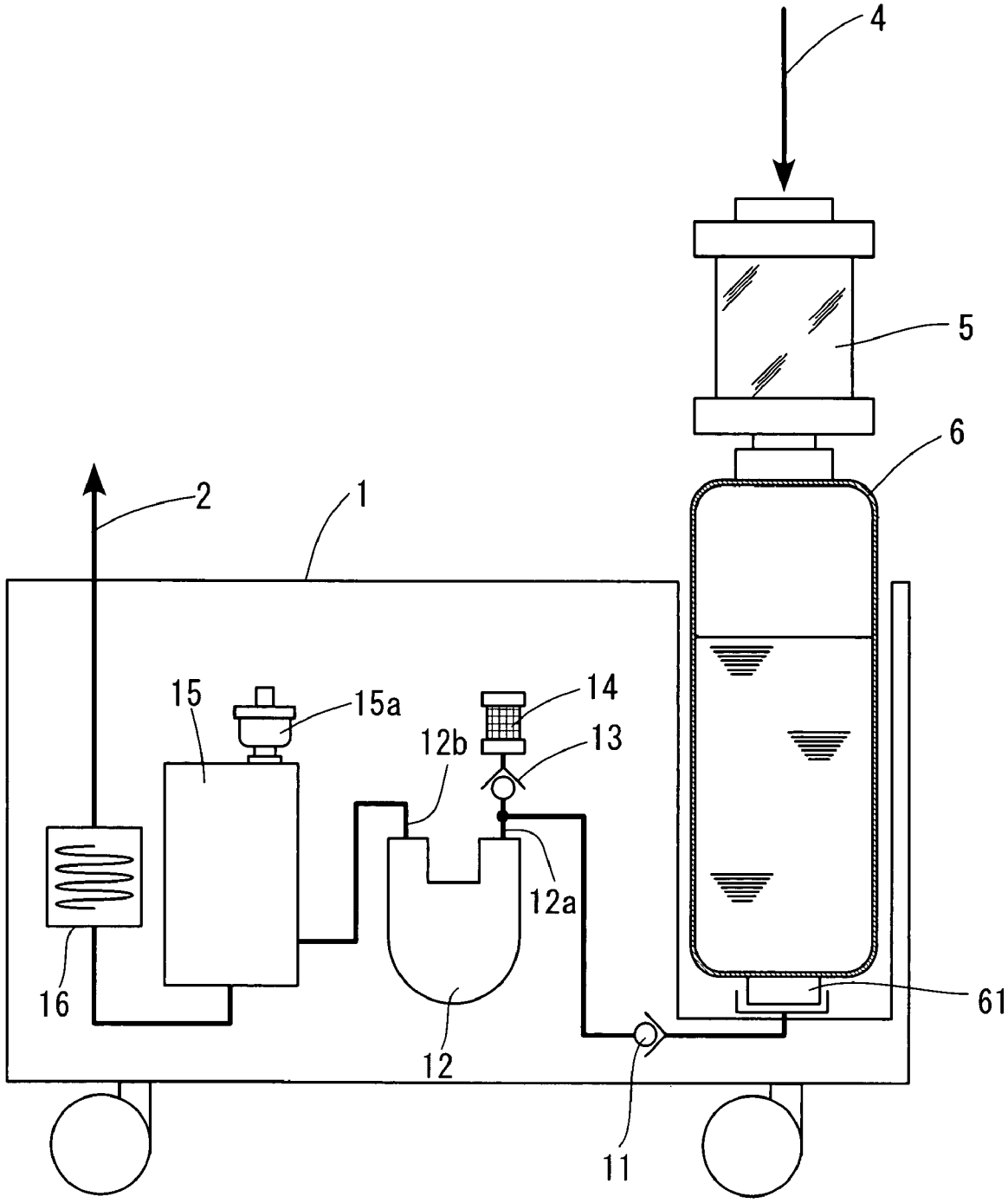
FIG. 2 is a diagram illustrating a configuration of the main body in accordance with aspects of the present invention.

As shown in FIG. 2, the valve opening mechanism 61 which opens a valve within the cartridge tank 6, said cartridge tank 6 being set to the main body 1, is provided below the cartridge tank 6. When the cartridge tank 6 is set to the main body 1, as shown in FIG. 2, the inside of the cartridge tank 6 is connected to a screw pump 12 via a check valve 11. An induction portion 12*a* of the screw pump 12 is connected to an air filter 14 via a check valve 13. Therefore, when the screw pump 12 is operated, a suitable amount of air as well as the cleaning liquid in the cartridge tank 6 is sucked in by the screw pump 12 via the air filter 14. Air bubbles are sheared and refined by an impeller which rotates in the screw pump 12 so that air is dissolved into the cleaning liquid.

The cleaning liquid in which air is dissolved into is discharged together with undissolved air bubbles from a discharge portion 12*b* and is sent to a vapor-liquid separating tank 15. In the vapor-liquid separating tank 15, the dissolving of the air in the cleaning liquid is further enhanced, and any undissolved air is ejected from a relief valve 15*a* into the air.

The cleaning liquid in which a lot of air has been dissolved in passes through both the vapor-liquid separating tank 15 and a heater unit 16 and is discharged from the discharge pipe 2 into the washing cap 3 (as shown in FIG. 1). The heater unit 16 checks the temperature of the cleaning liquid either continuously or periodically, and heats the cleaning liquid so that the cleaning liquid has a pre-set suitable temperature of, for example, approximately 40° C.

Figure 3:
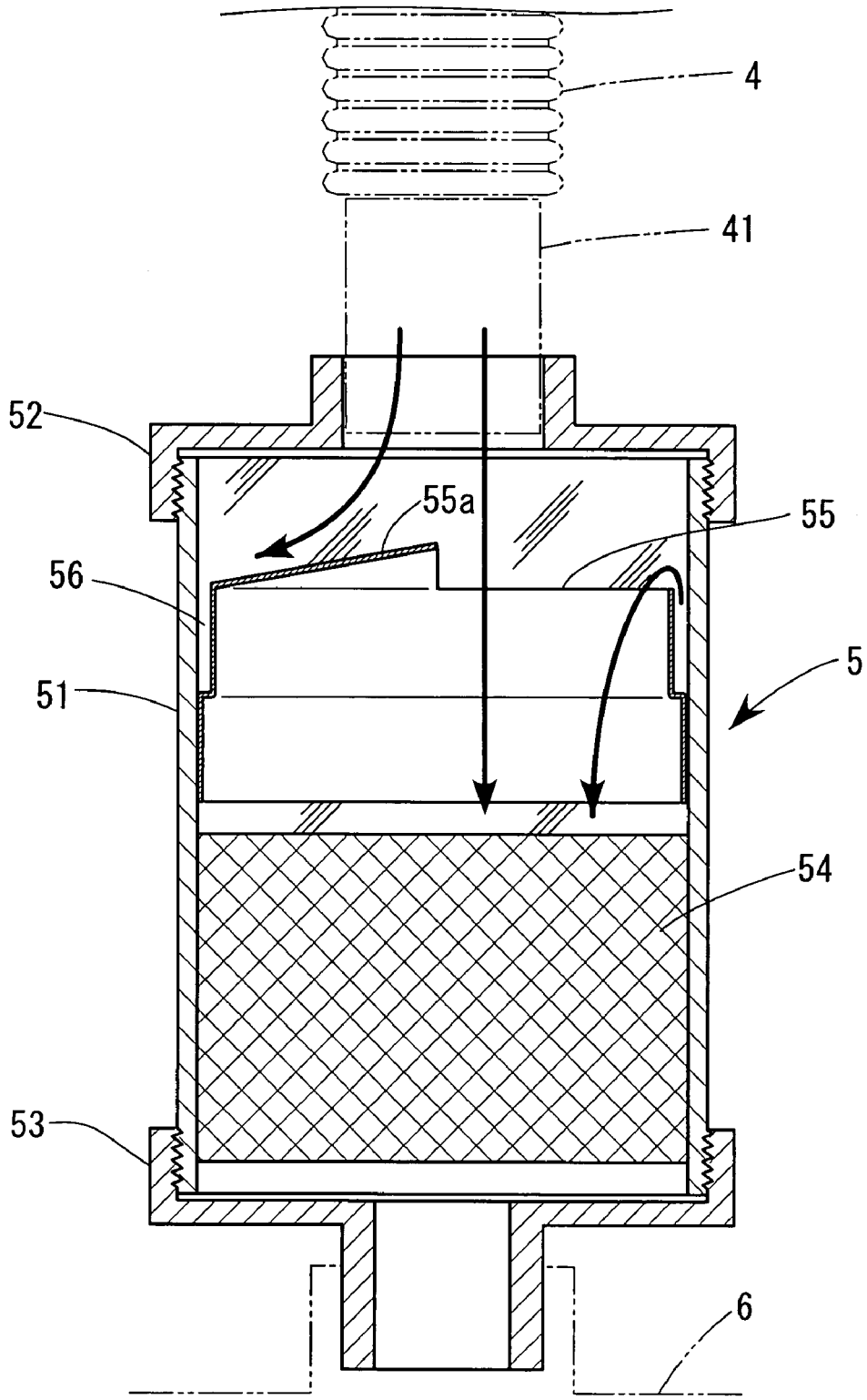
FIG. 3 is a sectional view illustrating a configuration of the filter unit in accordance with aspects of the present invention.

With reference to FIG. 3, the filter unit 5 has a cylindrical transparent case main body 51, and an upper cover 52 and a lower cover 53 are screwed into the upper and lower portions of the case main body. A filter material 54 is attached to approximately half of the case main body 51. When the upper cover 52 and the lower cover 53 are removed from the case main body 51, the filter material 54 can be easily pulled out of the case main body 51. Therefore, after the filter unit 5 has been used, the upper cover 52 and the lower cover 53 may be removed from the case main body 51 and the various respective parts of such washed. A new filter material 54 may then be attached so that the filter unit 5 can be reassembled as new.

A check member 55 is used for checking the color of the recovered cleaning liquid for any unwanted material, and is made of white opaque resin. When the check member 55 is inserted into the case main body 51, a space 56 is formed over its entire periphery. Since a semicircular canopy top 55*a* is provided over the upper end of the check member 55, the cleaning liquid which passes through the recovery pipe 4 to be recovered collides against the canopy top 55*a* and is allowed into the space 56. The cleaning liquid which overflows from the space 56 is filtered by the filter material 54 and is recovered into the cartridge tank 6.

Figure 4:
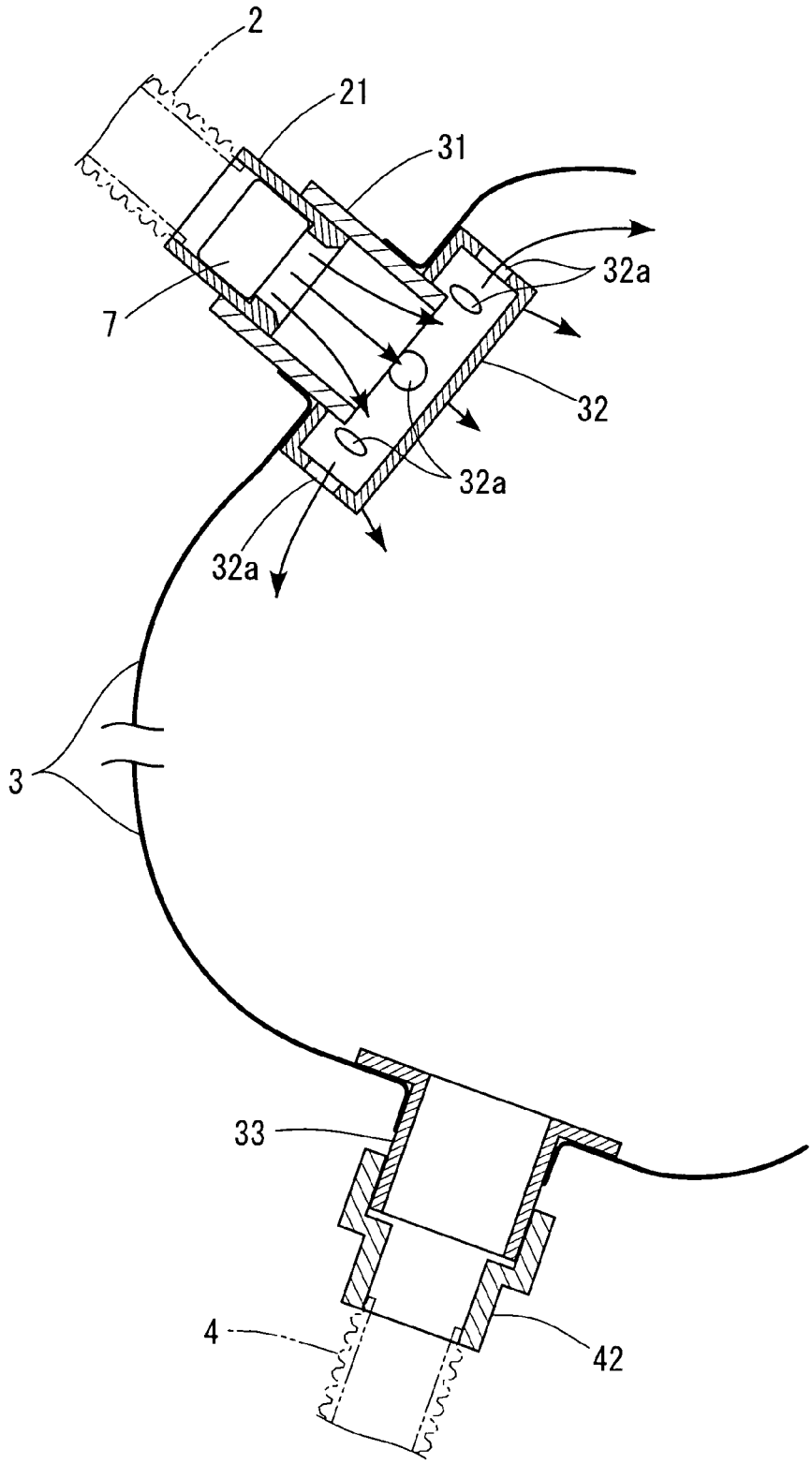
FIG. 4 is a diagram illustrating a configuration of the washing cap in accordance with aspects of the present invention.

With reference to FIG. 4, a female joining section 31 is attached to a position on the washing cap 3 corresponding to a portion of a user's forehead at the time of attaching the cap 3 to the user's head. When a male joining section 21 provided at the front end of the discharged pipe 2 is inserted into the female joining section 31, the discharge pipe 2 is connected to the washing cap 3. A nozzle unit 7 which generates microbubbles is mounted into the female joining section 21.

The nozzle unit 7 contains a plurality of orifice plates arranged in series. Every time the cleaning liquid passes through each of these orifice plates, the cleaning liquid is compressed and then expanded. The air which is dissolved in the cleaning liquid turns into microbubbles during this process, and as such, microbubbles are generated in the cleaning liquid.

A flow dividing section 32 is mounted onto the lower-stream side of the female joining section 31. A plurality of flow dividing ports 32*a* is provided to an outer periphery of the flow dividing section 32. The cleaning liquid containing the microbubbles which is discharged from the nozzle unit 7 is dispersed in a plurality of directions by the flow dividing section 32 so as to be discharged into the washing cap 3.

Further to this, a male joining section 33 for drainage is mounted onto a position of the washing cap 3 corresponding to the back of the user's head at the time of attaching the washing cap 3 to such. A female joining section 42 formed on one end of the discharge pipe 4 is mounted onto the male joining section 33. Therefore, the cleaning liquid discharged into the washing cap 3 passes through the male joining section 33 and flows out into the recovery pipe 4.

Figure 5:
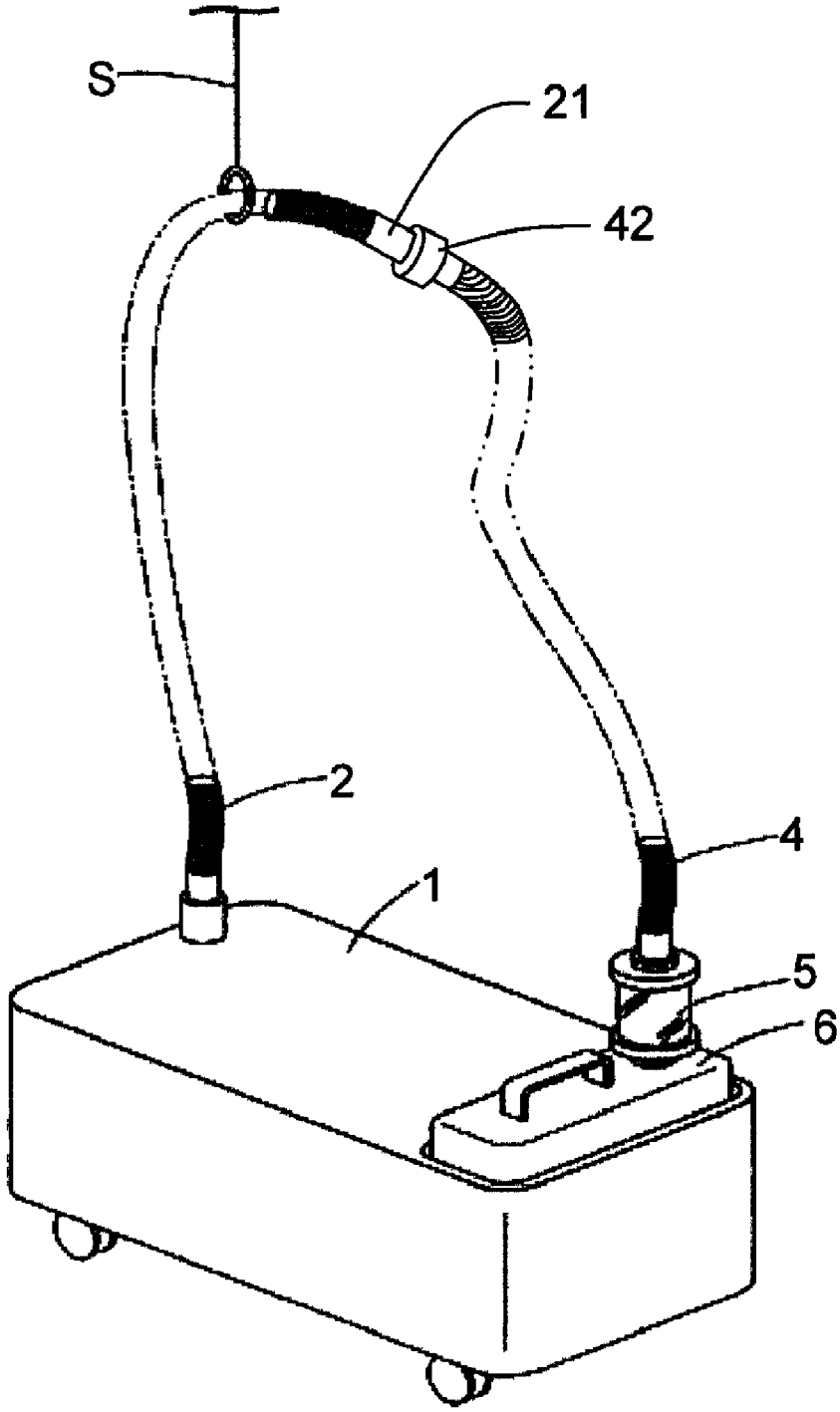
FIG. 5 is a diagram illustrating a configuration of the washing device shown in FIG. 1, wherein the discharge pipe is connected directly to the recovery pipe in accordance with aspects of the present invention.

The male joining section 21 and the male joining section 33 have the same diameter. Therefore, as shown in FIG. 5, the male joining section 21 of the discharge pipe 2 can be connected directly to the female joining section 42 of the recovery pipe 4 without any need for the washing cap 3.

With the above detailed configuration, when washing is started, the cartridge tank filled with pure cleaning liquid is set into the main body 1. As a result, the cleaning liquid in the cartridge tank 6 flows out due to its own weight so that the height of the water in the main body 1 remains relatively constant. As a result, the screw pump 12 is filled with cleaning liquid, and the cleaning liquid serves as priming water.

The discharge pipe 2 is connected directly to the recovery pipe 4 without the need for the washing cap 3. In this state, operation of the screw pump 12 is then initiated. The cleaning liquid passes from the discharge pipe 2 through the recovery pipe 4 and into the filter unit 5 and is recovered into the cartridge tank 6. The cleaning liquid is therefore circulated in this manner. The cleaning liquid is heated by the heater unit 16 during the circulation. When the temperature of the cleaning liquid reaches the set temperature, the screw pump 12 operation is suspended. The discharge pipe 2 is then separated from the recovery pipe 4, and both pipes are connected to the washing cap 3, which is attached to the user's head.

When all connections are completed, the washing of the user's head is then started. When the screw pump 12 is again operated, the cleaning liquid heated to the suitable temperature is discharged from the discharge pipe 2 into the washing cap 3. A lot of microbubbles are mixed with the cleaning liquid to be discharged, and the head portion is washed by these. The cleaning liquid discharged into the washing cap 3 passes through the recovery pipe 4 and returns to the filter unit 5 to be filtered and recovered into the washing tank 6. This circulating cycle continues for approximately 10 minutes so that the user's head is washed.

When the wash is ended, the discharge pipe 2 and the recovery pipe 4 are removed from the washing cap 3 and are connected to each other directly. The screw pump 12 is then operated for a few minutes. During this operation, any dirt and unwanted material remaining in the discharge pipe 4 is filtered by the filter unit 5. The washing cap is removed from the user's head which has now been washed, and the user's head may be rinsed by a shower in another location.

The used filter unit 5 is then disassembled and washed, and a new filter material 54 is then inserted so that the filter unit 5 can be reassembled. The cartridge tank 6 which recovers the used cleaning liquid is removed from the main body 1, and a cartridge tank 6 which is filled with clean water is then inserted into the main body. The clean water is circulated so that the circulation path, including the main body 1, is washed. At this time, the recovery pipe 4 is connected directly to the cartridge tank 6 without first going through the filter unit 5.

When the wash using the clean water is ended, the cartridge tank 6 is replaced by another cartridge tank filled with new cleaning liquid, and a new filter unit 5 is mounted thereon. As a result, preparations have been made for the next head washing procedure.

In the above detailed embodiment, one flow dividing section 32 is mounted into the washing cap 3, but when a plurality of flow dividing sections is mounted, they are connected by a short duct line. A female joining section 31 is mounted onto a joining portion of the duct line, and the flow of the cleaning liquid with which a lot of microbubbles are mixed into is divided into a plurality of flow dividing sections 32*a* so that the cleaning liquid may be dispersed into the washing cap 3.

It should be appreciated that the present invention is not limited to the above-detailed embodiment, and various modifications may be made by those skilled in the art, and such modifications may fall within the scope of the present invention.

What is claimed is:

1. A washing device for washing a portion of a user's head comprising:

a main body;

a cartridge tank removably attached to the main body having an inlet and an outlet and filled with a cleaning liquid;

a washing cap having a male joining section and a female joining section;

a heater unit;

a discharge pipe attached to the main body and having a male joining section at a distal end;

a recovery pipe attached to the cartridge tank and having a female joining section at a distal end;

and a pump;

wherein when the male joining section of the discharge pipe is directly connected to the female joining section of the recovery pipe, the pump circulates the cleaning fluid through the heater unit to heat the cleaning fluid to a set temperature, and wherein when the cleaning fluid reaches the set temperature, the male joining section of the discharge pipe and the female joining section of the recovery pipe are disconnected, the male joining section of the discharge pipe being attached to the female joining section of the washing cap and the female joining section of the recovery pipe being attached to the male joining section of the washing cap, and the pump circulates the cleaning fluid through the washing cap to wash the user's head.

2. The washing device for washing a portion of a user's head according to claim 1, further comprising a vapor-liquid separating tank in communication with the pump.

3. The washing device for washing a portion of a user's head according to claim 1, further comprising a nozzle mechanism which generates microbubbles in the cleaning liquid and which is mounted to a vicinity of a front end of the discharge pipe.

4. The washing device for washing a portion of a user's head according to claim 1, further comprising a dispersing unit which disperses the cleaning liquid to be discharged into the washing cap in a plurality of directions inside the washing cap.

5. The washing device for washing a portion of a user's head according to claim 1, further comprising a filter unit that includes a replaceable filter for removing dirt mixed with the cleaning liquid.

6. The washing device for washing a portion of a user's head according to claim 5, wherein the filter unit further comprises:

a transparent casing for housing the replaceable filter; and a check member having a semicircular canopy top, wherein the check member is inserted into the transparent casing to form a space around a periphery thereof so that the cleaning liquid recovered by the recovery section collides against the canopy top and is allowed into the space, and wherein the cleaning liquid that overflows from the space passes through the replaceable filter prior to being returned to the cartridge tank.

7. The washing device for washing a portion of a user's head according to claim 6, wherein the check member is made of white opaque resin for checking the color of the recovered cleaning liquid.

8. A washing device for washing a portion of a user's head comprising:

a main body;

a cartridge tank removably attached to the main body having an inlet and an outlet and filled with a cleaning liquid;

a washing cap having a male joining section and a female joining section;

a discharge pipe attached to the main body and having a male joining section at a distal end;

a recovery pipe attached to the cartridge tank and having a female joining section at a distal end;

and a pump;

wherein when the male joining section of the discharge pipe is directly connected to the female joining section of the recovery pipe, the pump circulates the cleaning fluid through the discharge pipe and the recovery pipe, and wherein when the male joining section of the discharge pipe and the female joining section of the recovery pipe are disconnected from each other, the male joining section of the discharge pipe attaches to the female joining section of the washing cap and the female joining section of the recovery pipe attaches to the male joining section of the washing cap, and the pump circulates the cleaning fluid through the washing cap to wash the user's head.

9. The washing device for washing a portion of a user's head according to claim 8, further comprising a nozzle mechanism which generates microbubbles in the cleaning liquid and is mounted to a vicinity of a front end of the discharge pipe.

10. The washing device for washing a portion of a user's head according to claim 8, further comprising a dispersing unit which disperses the cleaning liquid to be discharged into the washing cap in a plurality of directions inside the washing cap.

11. The washing device for washing a portion of a user's head according to claim 8, further comprising a replaceable filter for removing dirt from the circulating cleaning fluid.

12. The washing device for washing a portion of a user's head according to claim 8, further comprising a vapor-liquid separating tank in communication with the pump.

* * * * *